US008863708B2

(12) United States Patent
Watanabe et al.

(10) Patent No.: US 8,863,708 B2
(45) Date of Patent: Oct. 21, 2014

(54) VALVE TIMING CONTROL DEVICE OF INTERNAL COMBUSTION ENGINE

(75) Inventors: Atsushi Watanabe, Atsugi (JP); Yasuhide Takada, Atsugi (JP); Osamu Fujita, Atsugi (JP); Tetsuya Shibukawa, Atsugi (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 0 days.

(21) Appl. No.: 13/614,256

(22) Filed: Sep. 13, 2012

(65) Prior Publication Data

US 2013/0233261 A1 Sep. 12, 2013

(30) Foreign Application Priority Data

Mar. 6, 2012 (JP) ..... 2012-048697

(51) Int. Cl.
*F01L 1/34* (2006.01)

(52) U.S. Cl.
USPC ..... 123/90.15; 123/90.17; 464/160

(58) Field of Classification Search
CPC ..... F01L 1/3442; F01L 2001/3442; F01L 2001/34463; F01L 2001/34466; F01L 2001/34476; F01L 2800/01; F01L 2800/14
USPC ..... 123/90.15, 90.17; 464/160
See application file for complete search history.

(56) References Cited

U.S. PATENT DOCUMENTS 7,409,937 B2 * 8/2008 Hisahara et al. ..... 123/90.17

FOREIGN PATENT DOCUMENTS

JP 2003-222010 A 8/2003

* cited by examiner

*Primary Examiner* — Ching Chang
(74) *Attorney, Agent, or Firm* — Foley & Lardner LLP

(57) ABSTRACT

Even if an internal combustion engine is stopped having a lock pin of a vane rotor kept disengaged from a lock recess, subsequent engine starting can instantly move the vane rotor to a desired angular position where the lock member an be engaged with the lock recess. The vane rotor has therein two passage control mechanisms each having a hydraulically actuated valve body. When the valve body is moved to a given position, retarding and advancing hydraulic holes become communicated to each other through an annular groove of the valve body. Due to this ON communication, retarding and advancing operation chambers become communicated, so that reciprocative swing movement of the vane rotor induced by an alternating torque produced at the starting of the engine is effectively made and thus the vane rotor can be quickly turned to the desired angular position for ease of engine starting.

19 Claims, 9 Drawing Sheets

VALVE TIMING CONTROL DEVICE OF INTERNAL COMBUSTION ENGINE

BACKGROUND OF THE INVENTION

1. Field of the Invention

The present invention relates in general a valve timing control device of an internal combustion engine, which controls an OPEN/CLOSE timing of intake and/or exhaust valves in accordance with an operation condition of the engine.

2. Description of Related Art

Japanese Laid-open Patent Application (Tokkai) 2003-222010 shows a vane-type valve timing control device which, at the time of stopping the internal combustion engine, locks a vane rotor to a given angular position between the most retarded angular position and the most advanced angular position by using a lock pin engageable with a lock hole.

That is, in the device of the above publication, when the engine is stopped, the vane rotor is enforcedly turned, while repeating a reciprocative swing movement, to the given angular position by the power of a positive/negative alternating torque produced by valve springs and locked at the given angular position due to engagement of the lock pin with the lock hole. With this locking of the vane rotor at the given angular position, subsequent engine starting is smoothly carried out.

SUMMARY OF THE INVENTION

However, if, upon stopping of the engine, the lock pin fails to engage with the lock hole having advancing and retarding operation chambers kept filled with a certain amount of hydraulic fluid, immediate application of the alternating torque to the vane rotor does not induce a sufficient reciprocative swing movement of the vane rotor and thus it takes a longer time to engage the lock pin to the lock hole. That is, in the device of the publication, there is a high possibility that the vane rotor fails to be turned to the locked given angular position. Of course, in this case, subsequent engine starting is not smoothly carried out.

It is therefore an object of the present invention to provide a valve timing control device of an internal combustion engine, which is free of the above-mentioned drawback.

That is, in accordance with the present invention, there is provided a valve timing control device of an internal combustion engine, which comprises an annular housing rotated by a crankshaft of the engine and having a plurality of shoes on a peripheral inner surface thereof, adjacent two of the shoes defining therebetween an operation chamber; a vane rotor connected to a camshaft of the engine to rotate therewith, the vane rotor being formed with vanes each dividing the operation chamber into an advancing operation chamber and a retarding operation chamber, the vane rotor being turned in an advancing or retarding direction relative to the annular housing when a hydraulic pressure is supplied to or discharged from the advancing and retarding operation chambers respectively; a first lock member provided by one of the vane rotor and the annular housing and movable toward and away from the other of the vane rotor and the annular housing with a driving force different from the hydraulic pressure supplied to the operation chambers; a second lock member provided by one of the vane rotor and the annular housing and movable toward and away from the other of the vane rotor and the annular housing with a driving force different from the hydraulic pressure supplied to the operation chambers; a first lock recess provided by the other of the vane rotor and the annular housing and suppressing, when engaged with the first lock member, at least turning of the vane rotor in a retarding direction from a position between the most advanced and most retarded angular positions; a second lock recess provided by the other of the vane rotor and the annular housing and suppressing, when engaged with the second lock member, at least turning of the vane rotor in an advancing direction from a position where the turning of the vane rotor in the retarding direction is suppressed due to engagement of the first lock member with the first lock recess; a communication passage provided by one of the vane rotor and the annular housing to communicate the advancing and retarding operation chambers; and a passage control mechanism that establishes the communication between the advancing and retarding operation chambers through the communication passage when the engine is stopped and reduces a cross sectional area of the communication passage when, after starting of the engine, the engine comes to show a predetermined speed or higher.

In accordance with a second aspect of the present invention, there is provided a valve timing control device of an internal combustion engine, which comprises an annular housing rotated by a crankshaft of the engine and having a plurality of shoes on a peripheral inner surface thereof, adjacent two of the shoes defining therebetween an operation chamber; a vane rotor connected to a camshaft of the engine to rotate therewith, the vane rotor being formed with vanes each dividing the operation chamber into an advancing operation chamber and a retarding operation chamber, the vane rotor being turned in an advancing or retarding direction relative to the annular housing when a hydraulic pressure from an oil pump is supplied to or discharged from the advancing and retarding operation chambers respectively; a lock mechanism provided between the vane rotor and the annular housing to suppress a turning of the vane rotor relative to the annular housing when a hydraulic pressure different from the hydraulic pressure supplied to the operation chambers is applied to the lock mechanism; a communication passage provided by one of the vane rotor and the annular housing to communicate the advancing and retarding operation chambers; and a passage control mechanism that opens the communication passage when a discharge pressure of the oil pump is lower than a predetermined value and reduces a cross sectional area of the communication passage when the discharge pressure of the oil pump increases to the predetermined value.

In accordance with a third aspect of the present invention, there is provided a valve timing control device of an internal combustion engine, which comprises a drive rotating body driven by a crankshaft of the engine; a driven rotating body connected to a camshaft of the engine to rotate therewith, the driven rotating body dividing an interior of the drive rotation body into an advancing operation chamber and a retarding operation chamber, the driven rotating body being turned in an advancing or retarding direction relative to the drive rotating body when a hydraulic pressure is supplied to or discharged from the advancing and retarding operation chambers respectively; a first lock member provided by one of the drive and driven rotating members and movable toward and away from the other of the drive and driven rotating members with a hydraulic pressure different from the hydraulic pressure supplied to the operation chambers; a second lock member provided by one of the drive and driven rotating members and movable toward and away from the other of the driven and driven rotating members with a hydraulic pressure different from the hydraulic pressure supplied to the operation chambers; a first lock recess provided by the other of the drive and driven rotating members and suppressing, when engaged with the first lock member, a turning of the driven rotating member in a retarding direction from a position between the most advanced and most retarded angular positions; a second lock recess provided by the other of the drive and driven rotating members and suppressing, when engaged with the second lock member, a turning of the driven rotating member in an advancing direction from a position where the turning of the driven rotating member in the retarding direction is suppressed due to engagement of the first lock member and the second lock recess; and a communication passage provided by one of the drive and driven rotating members, the communication passage communicating the advancing operation chamber and the retarding operation chamber when the engine is stopped, and reducing a cross sectional area of the communication passage when, after starting of the engine, the engine comes to show a predetermined speed or higher.

BRIEF DESCRIPTION OF THE DRAWINGS

Other objects and advantages of the present invention will become apparent from the following description when taken in conjunction of the accompanying drawings, in which:

FIGS. 13A and 13B are sectional views of an essential portion of a valve timing control device which is a second embodiment of the present invention, in which FIG. 13A shows a condition in which a fluid communication between retarding and advancing operation chambers is blocked by a passage control mechanism and FIG. 13A shows a condition in which the fluid communication is established by the passage control mechanism.

DETAILED DESCRIPTION OF THE INVENTION

In the following, valve timing control devices of first and second embodiments of the present invention will be described in detail with reference to the accompanying drawings.

For ease of understanding, various directional terms, such as right, left, upper, lower, rightward and the like will be used in the following description. However, such terms are to be understood with respect to only a drawing or drawings on which corresponding part or portion is shown.

First Embodiment

Referring to FIGS. 1 to 12, there is shown a valve timing control device of a first embodiment of the present invention.

Figure 1:
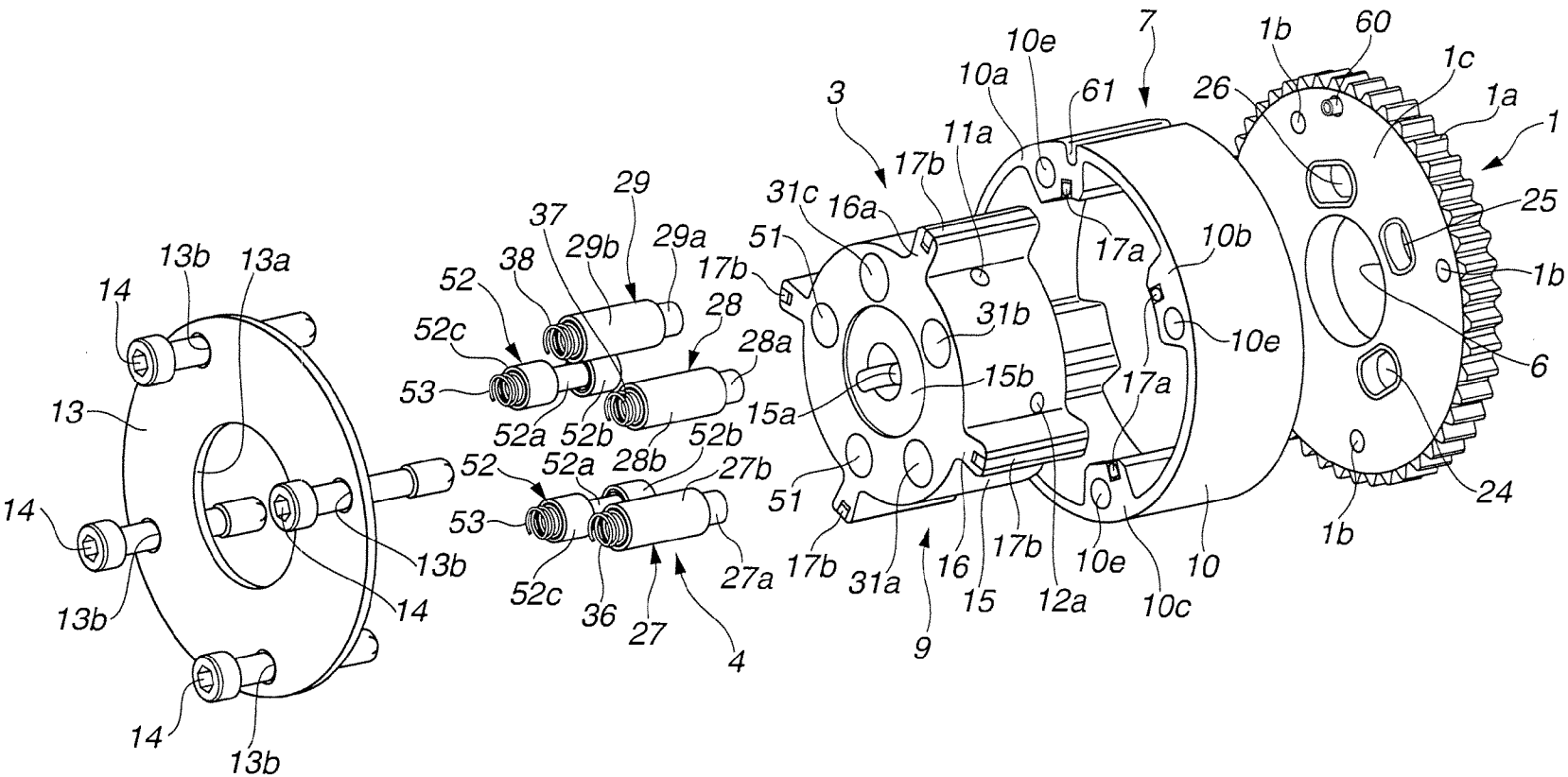
FIG. 1 is an exploded perspective view of an essential portion of a valve timing control device which is a first embodiment of the present invention.

As is seen from FIGS. 1 to 4, particularly from FIG. 1, the valve timing control device of the first embodiment comprises a sprocket 1 that is driven by a crankshaft of an engine (viz., internal combustion engine) through a timing chain (not shown), an intake camshaft 2 (see FIGS. 2 and 4) that extends along a longitudinal axis of the engine and is rotatable relative to sprocket 1, a phase varying mechanism 3 that is arranged between sprocket 1 and intake camshaft 2 to vary a relative phase therebetween, a lock mechanism 4 that locks phase varying mechanism 3 at an intermediate angular position between the most advanced and retarded angular positions, and a hydraulic circuit 5 that feeds and drains a hydraulic pressure to and from phase varying mechanism 3 and lock mechanism 4 to independently operate the mechanisms 3 and 4.

Figure 2:
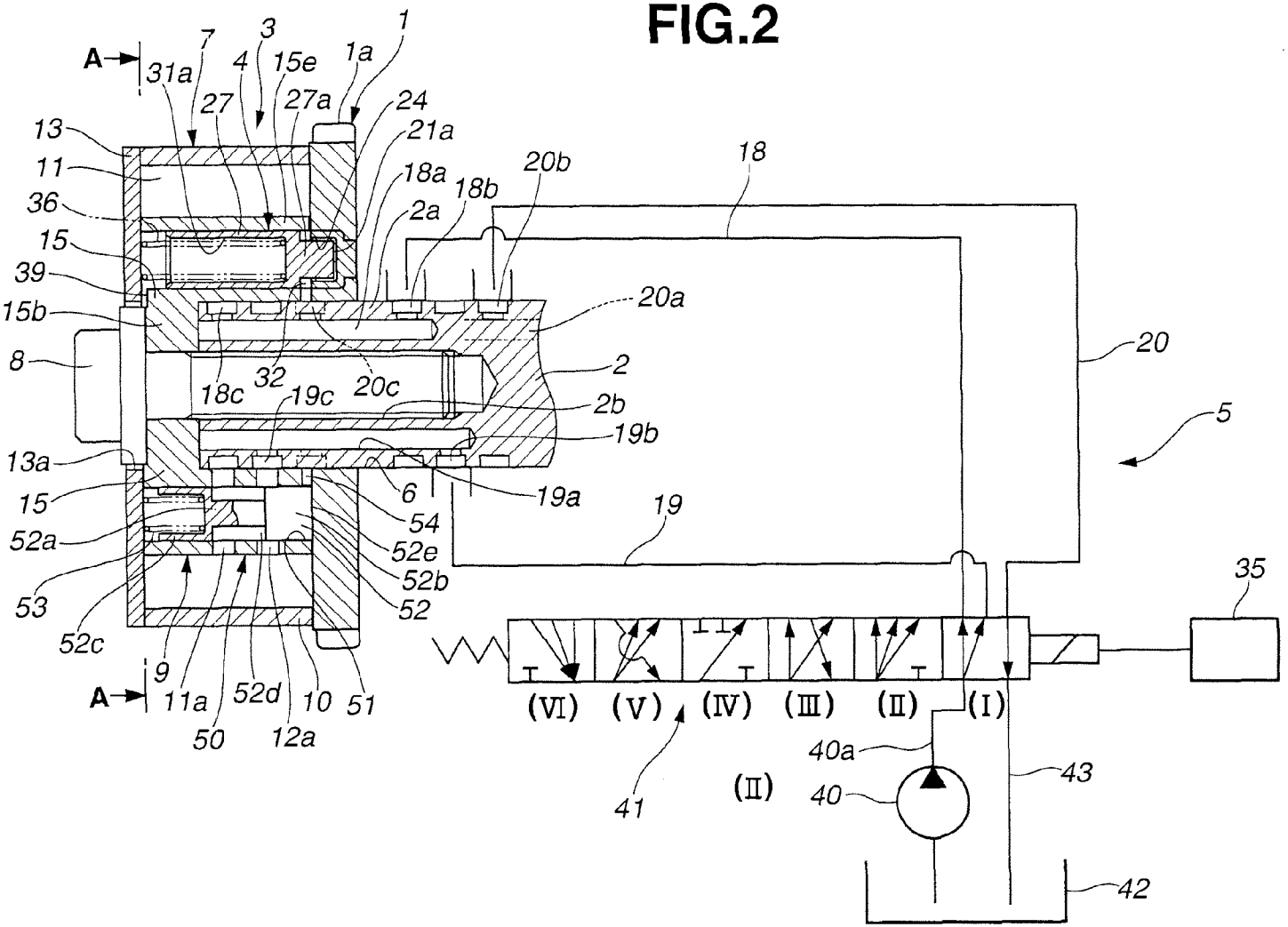
FIG. 2 is a block diagram of the valve timing control device of the first embodiment with a part shown in a sectioned manner.

As may be seen from FIG. 2, sprocket 1 can serve as a rear cover that covers a rear opening of an after-mentioned annular housing 7. As is seen from FIG. 1, sprocket 1 is a thicker circular metal plate having therearound a gear portion is meshed with the timing chain. Sprocket 1 is formed at a center part thereof with a circular support opening 6 that is rotatably supported by an end portion 2*a* (see FIG. 2) of intake camshaft 2. Sprocket 1 is formed at an outer peripheral portion thereof with four threaded bolt openings 1*b* that are arranged at equally spaced intervals.

As will be understood from FIG. 2, intake camshaft 2 is rotatably supported by a cylinder head (not shown) of the engine through cam shaft bearings (not shown). As is well known, camshaft 2 is formed with a plurality of cams (not shown) that induce open operation of intake valves when camshaft 2 is rotated. End portion 2*a* of camshaft 2 is formed with an axially extending threaded bore 2*b*.

Figure 3:
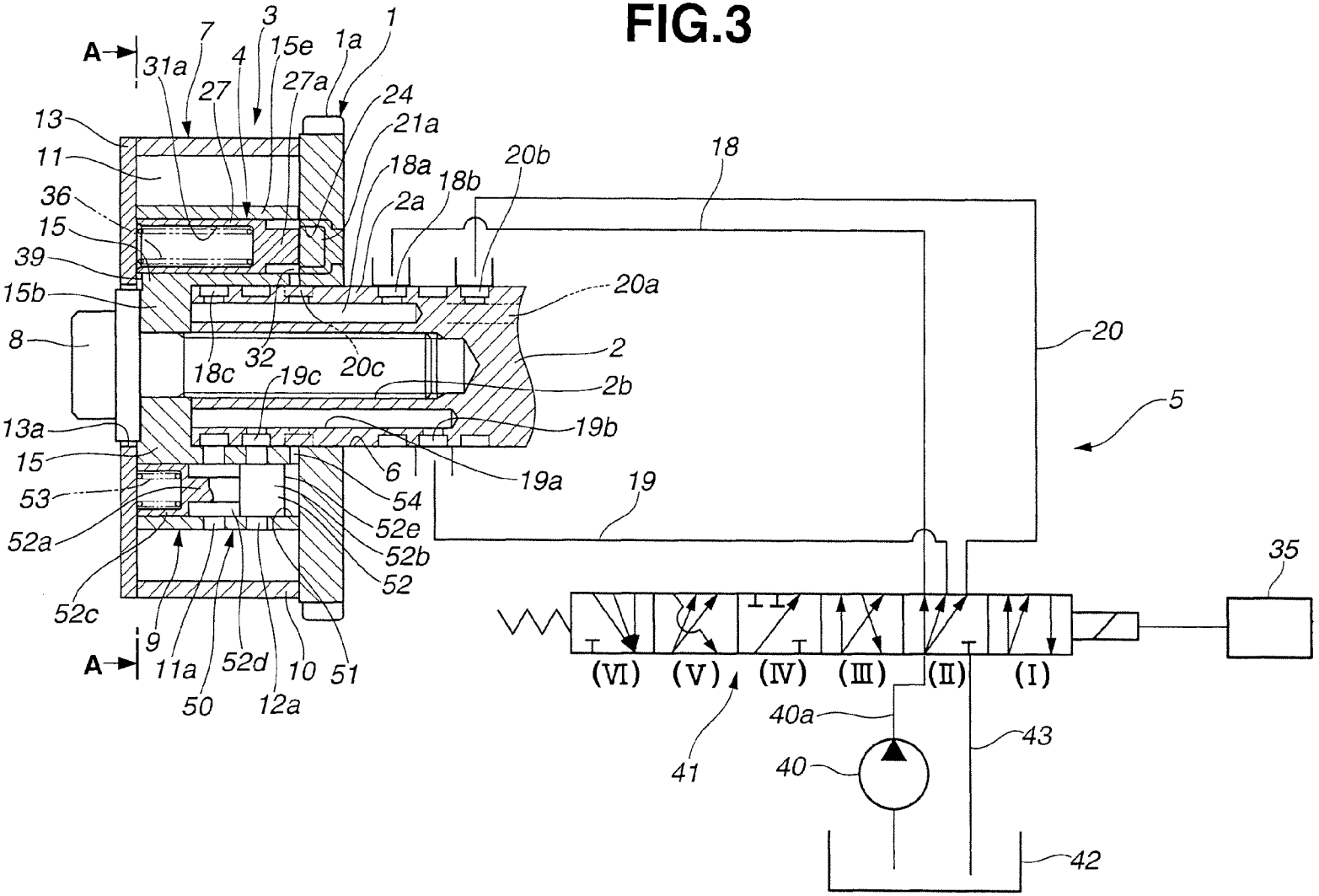
FIG. 3 is a view similar to FIG. 2, but showing a different condition (viz., a communication blocked condition produced by a passage control mechanism) of the valve timing control device of the first embodiment.

As is seen from FIGS. 1 to 3, phase varying mechanism 3 comprises an annular housing 7 that is coaxially and integrally connected to sprocket 1, a vane rotor 9 that is coaxially and integrally connected to end portion 2*a* of camshaft 2 through a cam bolt 8 engaged with threaded bore 2*b* and rotatably received in annular housing 7, four shoes 10*a*, 10*b*, 10*c* and 10*d* that are projected inward from an inner surface of annular housing 7, and four pairs of operation chambers 11 and 12 that are defined by four shoes 10*a*, 10*b*, 10*c* and 10*d* and after-mentioned four vanes of vane rotor 9. Each of the four pairs of operation chambers 11 and 12 has one retarding operation chamber 11 and one advancing operation chamber 12.

As is seen from FIGS. 1 and 2, annular housing 7 comprises a cylindrical body 10, a circular front plate 13 that is produced through a press forming and connected to a front open end of cylindrical body 10 to close the same, and the above-mentioned sprocket 1 that covers the rear open end of cylindrical body 10.

Cylindrical body 10 is made of a sintered metal and the above-mentioned shoes 10*a*, 10*b*, 10*c* and 10*d* are arranged at equally spaced intervals. As is seen from FIG. 1, each shoe 10*a*, 10*b*, 10*c* or 10*d* is formed with an axially extending bolt bore 10*e*.

As is seen from FIG. 1, circular front plate 13 is made of a thinner metal plate and has at a center portion thereof a circular opening 13*a*. Circular front plate 13 is formed at a peripheral portion thereof with four equally spaced bolt openings 13*b*.

Sprocket 1, cylindrical body 10 and front plate 13 are tightly united together by four bolts 14 each passing through bolt openings 13*b* and 10*e* and engaging with threaded bolt opening 1*b*.

Figure 4:
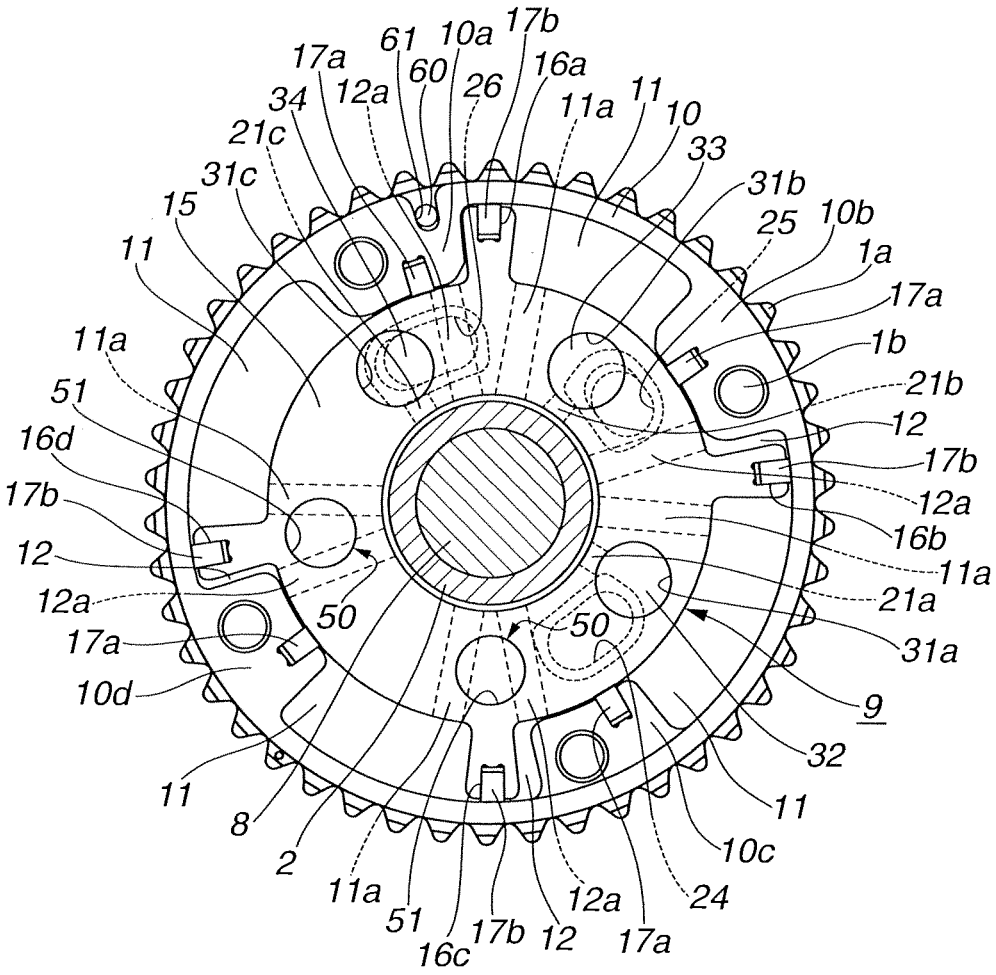
FIG. 4 is a sectional view taken along the line A-A of FIG. 2, showing a condition in which a vane rotor of the valve timing control device of the first embodiment takes the most retarded angular position.

As is seen from FIGS. 1 and 4, sprocket 1 is provided at its inside surface with a positioning pin 60, and cylindrical body 10 is formed at an outer surface near the first shoe 10*a* with a positioning groove 61. Upon coupling between sprocket 1 and cylindrical body 10, positioning pin 60 is engaged with positioning groove 61 to achieve a relative positioning therebetween.

Vane rotor 9 is made of a metal block and comprises a rotor 15 that is connected to the end portion of camshaft 2 through cam bolt 8 (see FIG. 2) and four equally spaced vanes 16*a*, 16*b*, 16*c* and 16*d* that are integrally formed on an outer surface of rotor 15. It is thus to be noted that these four vanes 16*a*, 16*b*, 16*c* and 16*d* are spaced from one another by about 90 degrees.

As shown in FIG. 1, rotor 15 is shaped generally cylindrical and has at a central portion thereof a bolt hole 15*a*. A front end of rotor 15 is formed with a circular recess 15*b* onto which a head portion of the above-mentioned cam bolt 8 is seated.

When rotor 15 is properly installed in cylindrical body 10, leading edges of four shoes 10*a*, 10*b*, 10*c* and 10*d* of cylindrical body 10 slidably contact to an outer cylindrical surface of rotor 15. As shown, each shoe 10*a*, 10*b*, 10*c* or 10*d* has generally a shape of rectangular parallelepiped.

More specifically, each shoe 10*a*, 10*b*, 10*c* or 10*d* has at a leading edge thereof a seal member 17*a* that slidably contacts to the outer cylindrical surface of rotor 15. Each seal member 17*a* has a generally U-shaped cross section and is set in a seal groove (no numeral) formed in the leading edge of each shoe 10*a*, 10*b*, 10*c* or 10*d*. In a bottom of each seal groove, there is set a leaf spring for biasing seal member 17*a* toward the outer cylindrical surface of rotor 15.

As is seen from FIG. 1, four vanes 16*a*, 16*b*, 16*c* and 16*d* of rotor 15 are projected radially outward by a generally same degree, and each vane 16*a*, 16*b*, 16*c* or 16*d* is thinner than shoe 10*a*, 10*b*, 10*c* or 10*d* of cylindrical body 10. Upon coupling between rotor 15 and cylindrical body 10, each vane 10*a*, 10*b*, 10*c* or 10*d* is placed between neighboring two of the shoes 10*a*, 10*b*, 10*c* and 10*d*.

Each vane 16*a*, 16*b*, 16*c* or 16*d* has at a leading edge thereof a seal member 17*b* that slidably contacts to the inner cylindrical surface of cylindrical body 10. Each seal member 17*b* has a generally U-shaped cross section and is set in a seal groove (no numeral) formed in the leading edge of each vane 16*a*, 16*b*, 16*c* or 16*d*. In a bottom of each seal groove, there is set a leaf spring for biasing seal member 17*b* toward the inner cylindrical surface of cylindrical body 10.

Thus, due to provision of shoes 10*a*, 10*b*, 10*c* and 10*d* and sealing members 17*a* connected thereto and vanes 16*a*, 16*b*, 16*c* and 16*d* and sealing members 17*b* connected thereto, the above-mentioned four pairs of operation chambers 11 and 12 (viz., four retarding operation chambers 11 and four advancing operation chambers 12) are defined providing each pair of operation chambers 11 and 12 with a hermetic sealing therebetween.

As will be understood from FIG. 4, when vane rotor 9 makes a rotation in a retarding direction (viz., in a counterclockwise direction in FIG. 4) relative to cylindrical body 10, first vane 16*a* is finally brought into contact with first shoe 10*a* of cylindrical body 10. Upon this, vane rotor 9 takes the most retarded angular position.

Figure 6:
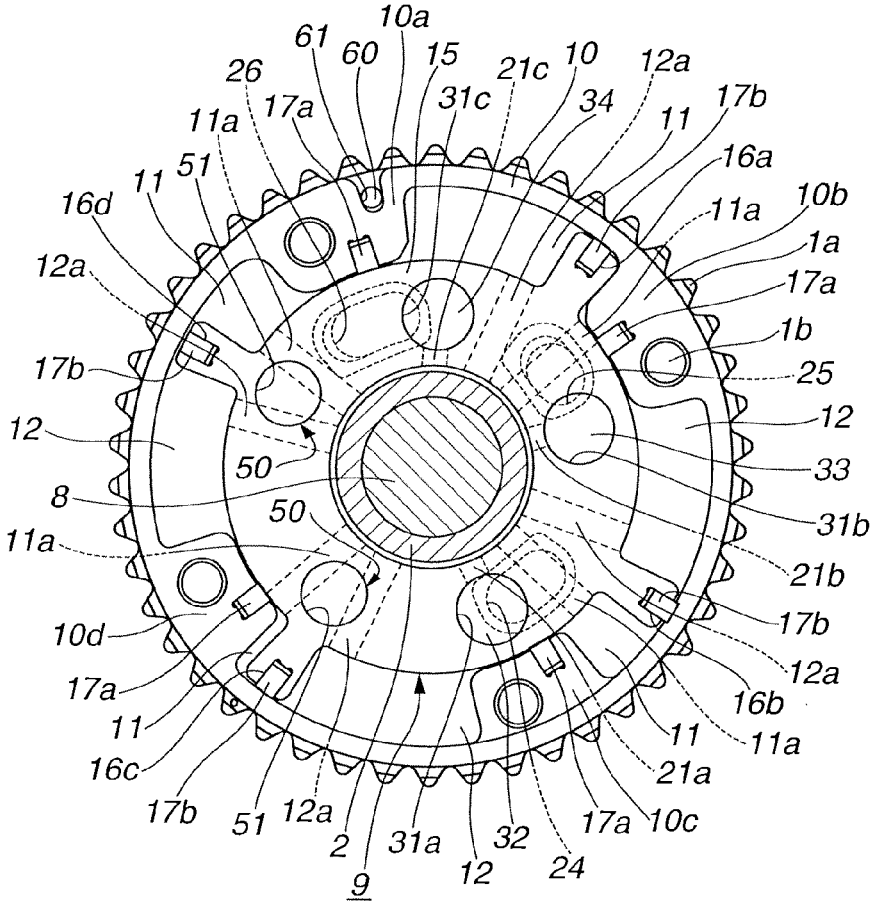
FIG. 6 is a view similar to FIG. 4, but showing a condition in which the vane rotor takes the most advanced angular position.

While, as is seen from FIG. 6, when vane rotor 9 makes the relative rotation in an advancing direction (viz., in a clockwise direction in FIG. 6), the first vane 16*a* is finally brought into contact with second shoe 10*b* of cylindrical body 10. Upon this, vane rotor 9 takes the most advanced angular position. That is, first and second shoes 10*a* and 10*b* of cylindrical body 10 serve as stopper means for the first vane 16*a* of vane rotor 9.

It is to be noted that while first vane 16*a* moves between first and second shoes 10*a* and 10*b*, remaining vanes 16*b*, 16*c* and 16*d* of vane rotor 9 are kept spaced from their corresponding shoes (10*b*, 10*c*), (10*c*, 10*d*) and (10*d*, 10*a*) of cylindrical body 10. This arrangement brings about improvement in contact accuracy between vane rotor 9 and shoes 10*a*, 10*b*, 10*c* and 10*d*. Furthermore, as will be described hereinafter, the speed for feeding a hydraulic pressure to retarding and advancing operation chambers 11 and 12 is increased thereby to allow vane rotor 9 to exhibit a higher response to a normal and reverse rotation.

It is to be noted that in a normal operation of the engine, first vane 16*a* moves between a range that is somewhat inside of first and second shoes 10*a* and 10*b*. That is, in the normal operation of the engine, first vane 16*a* has no chance to contact first and second shoes 10*a* and 10*b*.

As is mentioned hereinabove, between vanes 16*a*, 16*b*, 16*c* and 16*d* of vane rotor 9 and shoes 10*a*, 10*b*, 10*c* and 10*d* of cylindrical body 10, there are defined four retarding operation chambers 11 and four advancing operation chambers 12. These chambers 11 and 12 are connected to the hydraulic circuit 5 through retarding hydraulic holes 11*a* and advancing hydraulic holes 12*a* that are formed in vane rotor 9, as will be understood from FIG. 4.

The lock mechanism 4 is a means which, upon stop of the engine, locks vane rotor 9 to an intermediate angular position (viz., position shown by FIG. 5) between the most retarded angular position (viz., position shown by FIG. 4) and the most advanced angular position (viz., position shown by FIG. 6).

As is seen from the drawings, particularly FIG. 1, lock mechanism 4 comprises first, second and third lock recesses 24, 25 and 26 that are formed in the inside surface of sprocket 1, first, second and third lock pins 27, 28 and 29 that are axially slidably received in rotor 15 (viz., vane rotor 9) and engageable with first, second and third lock recesses 24, 25 and 26 in an after-mentioned manner, and a locking/unlocking hydraulic passage 20 that can cancel engagement of lock pins 27, 28 and 29 relative to first, second and third lock recesses 24, 25 and 26. These lock recesses 24, 25 and 26 are circular in shape.

As will be understood from FIG. 1, first lock recess 24 formed in the inside surface is of sprocket 1, which recess 24 faces a first larger diameter part 15*e* (see FIG. 7) of rotor 15, functions to receive a smaller diameter head portion 27*a* of first lock pin 27. The size of first lock recess 24 is slightly larger than that of head portion 27*a* of first lock pin 27 so that head portion 27*a* engaged with first lock recess 24 is permitted to make a slight movement in a circumferential direction in first lock recess 24.

It is to be noted that first lock recess 24 is placed at a position that corresponds to an intermediate angular position that is somewhat advanced from the most retarded angular position of vane rotor 9.

As is seen from FIG. 7, a bottom 24*a* of first lock recess 24 has the same depth as second bottoms 25*b* and 26*b* of second and third lock recesses 25 and 26 as will be described in detail hereinafter.

Accordingly, when, due to turning of vane rotor 9 in an advancing direction, head portion 27*a* of first lock pin 27 is brought into engagement with first lock recess 24 and moved into contact with the bottom 24*a* of the recess 24, back turning of vane rotor 9 in a retarding direction is stopped due to contact between the head portion 27*a* and an inside edge 24*b* of first lock recess 24.

As is seen from FIGS. 1 and 7 to 12, second lock recess 25 is formed in the inside surface 1*c* of sprocket 1 and has an arcuate shape curving around the center opening 6 of sprocket 1. As is seen from FIG. 7, second lock recess 25 has a bottom shaped like steps. That is, second lock recess 25 has a first bottom 25*a* and the above-mentioned second bottom 25*b*. As shown, respective inside walls formed on retarding sides of first and second bottoms 25*a* and 25*b* constitute vertical surfaces, and an inside wall formed on an advancing side of second bottom 25*b* constitutes a vertical surface 25*c*.

Second bottom 25*b* is somewhat elongated in an advancing direction. With such elongated shape, as is seen from FIGS. 11 and 12, second lock pin 28 engaged with second bottom 25*b* is permitted to move slightly in an advancing direction.

Third lock recess 26 is formed in the inside surface is of sprocket at a part facing a second larger diameter part 15*f* (see FIG. 7) of rotor 15. As is seen from FIG. 7, third lock recess 26 is larger than the above-mentioned second lock recess 25 and shaped arcuate.

It is to be noted that third lock recess 26 is placed at a position that corresponds to an intermediate angular position that is somewhat advanced from the most retarded angular position of vane rotor 9. Like second lock recess 25, also third lock recess 26 has a bottom shaped like steps. That is, third lock recess 26 has a first bottom 26*a* and the above-mentioned second bottom 26*b*. As shown, respective inside walls formed on retarding sides of first and second bottoms 26*a* and 26*b* constitute vertical surfaces, and an inside wall formed on an advancing side of second bottom 26*b* constitutes a vertical surface 26*c*.

As is seen from FIG. 2, each of first, second and third lock recesses 24, 25 and 25 is produced by tightly putting a cup-shaped small piece into an opening formed sprocket 1.

As is seen from FIG. 1, first lock pin 27 is axially slidably received in a first pin hole 31*a* that is formed in rotor 15 at a position near first lock recess 24.

Figure 7:
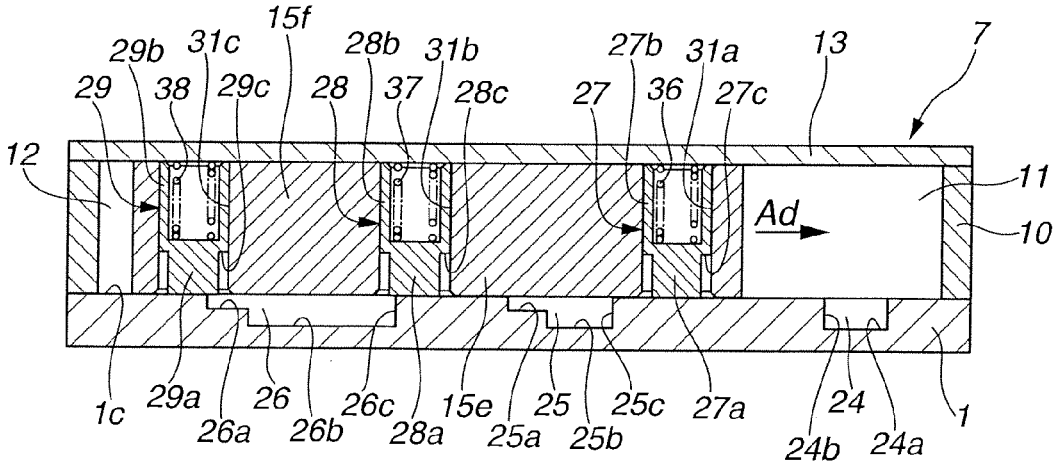
FIG. 7 is a developed sectional view of the valve timing control device of the first embodiment showing operation of lock pins at the time when the vane rotor takes a position near the most retarded angular position.

As is seen from FIGS. 1 and 7, first lock pin 27 comprises the above-mentioned smaller diameter head portion 27*a*, a larger diameter hollow body portion 27*b* extending from the head portion 27*a* and an annular pressure receiving surface 27*c* that is provided between head portion 27*a* and body portion 27*b*. As is seen from FIG. 7, the head portion 27*a* has a flat top that is able to intimately contact to the bottom 24*a* of first lock recess 24.

As is seen from FIGS. 1 and 7, first lock pin 27 is biased toward sprocket 1 by a first spring 36 compressed between front plate 13 and first lock pin 27. For receiving first spring 36, first lock pin 27 is formed with a bottomed bore, as shown.

As is seen from FIGS. 2, 3 and 4, in rotor 15, there is defined a first lock-cancelling operation chamber 32 from which hydraulic pressure is led to annular pressure receiving surface 27*c* of first lock pin 27. With such hydraulic pressure applied to the pressure receiving surface 27*c*, first lock pin 27 is disengaged from first lock recess 24 against the force of first spring 36.

As is seen from FIG. 1, second lock pin 28 is axially slidably received in a second pin hole 31*b* that is formed in rotor 15 at a position near second lock recess 25.

Like the above-mentioned first lock pin 27, also second lock pin 28 comprises a smaller diameter head portion 28*a*, a larger diameter hollow body portion 28*b* extending from the head portion 28*a* and an annular pressure receiving surface 28*c* that is provided between head portion 28*a* and body portion 28*b*. As is seen from FIG. 7, the head portion 28*a* has a flat top that is able to intimately contact to bottoms 25*a* and 25*b* of second lock recess 25.

As is seen from FIGS. 1 and 7, second lock pin 28 is biased toward sprocket 1 by a second spring 37 compressed between front plate 13 and second lock pin 28. For receiving second spring 37, second lock pin 28 is formed with a bottomed bore, as shown.

As will be understood from FIGS. 2, 3 and 4, in rotor 15, there is defined a second lock-cancelling operation chamber 33 from which hydraulic pressure is led to annular pressure receiving surface 28*c* of second lock pin 28. With such hydraulic pressure applied to the pressure receiving surface 28*c*, second lock pin 28 is disengaged from second lock recess 25 against the force of second spring 37.

As is seen from FIG. 1, third lock pin 29 is axially slidably received in a third pin hole 31*c* that is formed in rotor 15 at a position near third lock recess 26.

Like the above-mentioned first lock pin 27, also third lock pin 29 comprises a smaller diameter head portion 29*a*, a larger diameter hollow body portion 29*b* extending from the head portion 29*a* and an annular pressure receiving surface 29*c* that is provided between heat portion 29*a* and body portion 29*b*. As is seen from FIG. 7, the head portion 29*a* has a flat top that is able to intimately contact to bottoms 26*a* and 26*b* of third lock recess 26.

As is seen from FIGS. 1 and 7, third lock pin 29 is biased toward sprocket 1 by a third spring 38 compressed between front plate 13 and third lock pin 29. For receiving third spring 38, third lock pin 29 is formed with a bottomed bore, as shown.

As will be understood from FIGS. 2, 3 and 4, in rotor 15, there is defined a third lock-cancelling operation chamber 34 from which hydraulic pressure is led to annular pressure receiving surface 29*c* of third lock pin 29. With such hydraulic pressure applied to the pressure receiving surface 29*c*, third lock pin 29 is disengaged from third lock recess 26 against the force of third spring 38.

First to third lock recesses 24 to 26 and first to third lock pins 27 to 29 have a certain positional relation which will become apparent from the following description.

When vane rotor 9 takes the most retarded angular position (viz., the position as shown in FIG. 4), a condition shown in FIG. 7 is taken. That is, in such case, all of first, second and third lock pins 27, 28 and 29 are kept disengaged from their corresponding first, second and third lock recesses 24, 25 and 26. That is, in such case, a locked engagement of vane rotor 9 relative to sprocket 1 is not established. In other words, when vane rotor 9 is in the most restated angular position, relative movement or turning between vane rotor 9 and sprocket 1 is permitted.

Figure 8:
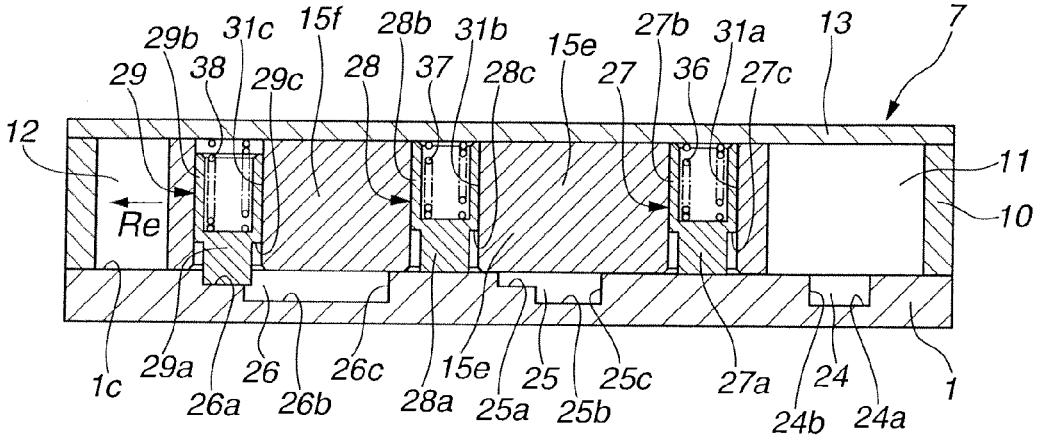
FIG. 8 is a view similar to FIG. 7, but showing operation of the lock pins at the time when, due to negative component of the alternating torque, the vane rotor is turned slightly in an advancing direction.

When thereafter vane rotor 9 is slightly turned in an advancing direction relative to sprocket 1, a condition shown in FIG. 8 is established. That is, in such case, third lock pin 29 is brought into engagement with first bottom 26*a* of third lock recess 26 due to the force of third spring 38. In this case, turning of vane rotor 9 in the retarding direction is suppressed. That is, a so-called semi-engaged condition of vane rotor 9 is established with third lock recess 26.

Figure 9:
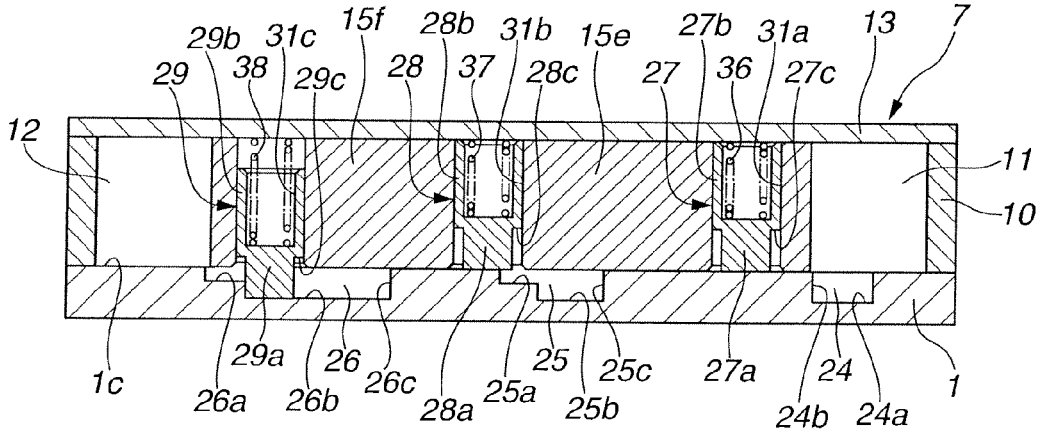
FIG. 9 is a view similar to FIG. 7, but showing operation of the lock pins at the time when the vane rotor is further turned in the advancing direction.

When thereafter vane rotor 9 is further turned slightly in the same direction (viz., in an advancing direction), third lock pin 29 is brought into engagement with second bottom 26*b* of third lock recess 26 as shown in FIG. 9. Also in this case, turning of vane rotor 9 in the retarding direction is suppressed. That is, so-called semi-engaged condition of vane rotor 9 is established at a somewhat advanced angular position.

It is to be noted that when third lock pin 29 takes the above-mentioned semi-engaged positions as shown in FIGS. 8 and 9, first and second lock pins 27 and 28 are kept disengaged from their corresponding first and second lock recesses 24 and 25 as shown.

When thereafter vane rotor 9 is further turned slightly in the same direction (viz., in the advancing direction) relative to sprocket 1, second lock pin 28 is brought into engagement with first bottom 25*a* of second lock recess 25 due to work of second spring 37. Due to the turning of vane rotor 9, third lock pin 29 moves to a middle part of second bottom 26*b* of third lock recess 26, as shown. Also in this case, back turning of vane rotor 9 in the retarding direction is suppressed due to contact of head portion 28*a* of second lock pin 28 with a vertical wall raised from first bottom 25*a*. That is, semi-engaged condition of vane rotor 9 is established.

Figure 11:
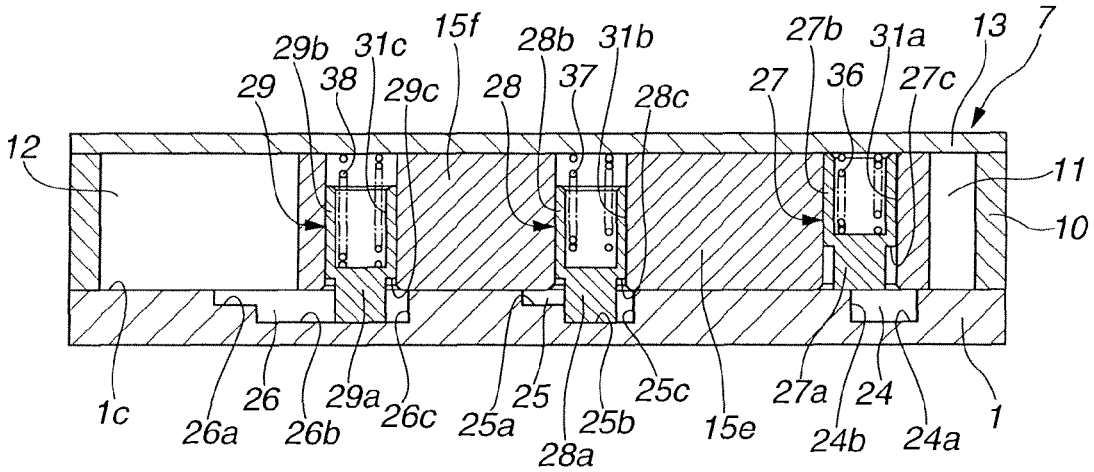
FIG. 11 is a view similar to FIG. 7, but showing operation of the lock pins at the time when the vane rotor is still further turned in the advancing direction.

When thereafter vane rotor 9 is further turned slightly in the same direction (viz., in the advancing direction) relative to sprocket 1, a condition as shown in FIG. 11 is established. That is, second lock pin 28 is brought into engagement with second bottom 25*b* of second lock recess 25. Due to the turning of vane rotor 9, third lock pin 29 moves to a position near vertical surface 26*c* raised from second bottom 26*b* of third lock recess 26, as shown. Also in this case, turning of vane rotor 9 in the retarding direction is suppressed due to contact of head portion 28*a* of second lock pin 28 with a vertical wall (no numeral) raised from second bottom 25*b*.

When thereafter vane rotor 9 is further turned in the same direction (viz., in the advancing direction), first lock pin 27 is brought into engagement with first lock recess 24 due to work of first spring 36. During the turning of vane rotor 9, third and second lock pins 29 and 29 move on their second bottoms 26*b* and 25*b*. That is, a condition as shown in FIG. 12 is established wherein third lock pin 29 engages with second bottom 26*b* of third lock recess 26, second lock pin 28 engages with second bottom 25*b* of second lock recess 25 and first lock pin 27 engages with first lock recess 24, as shown.

Figure 12:
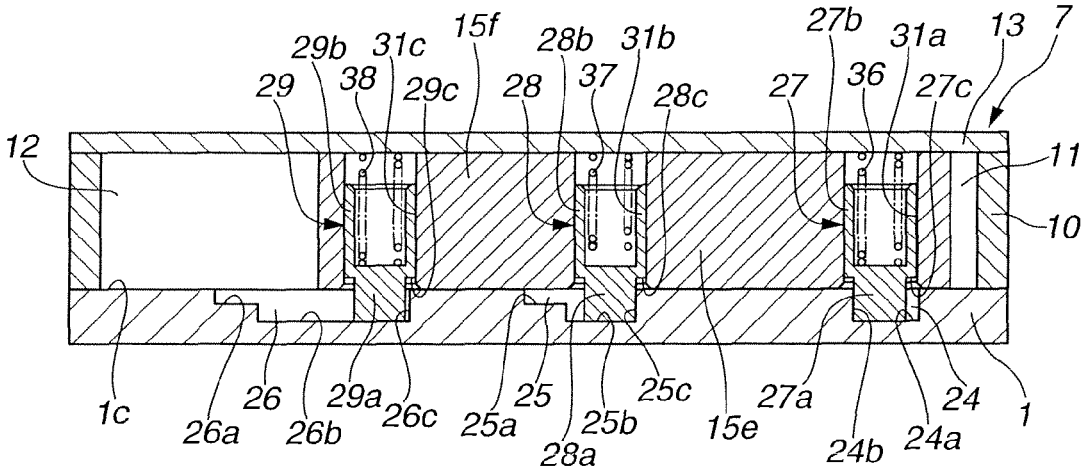
FIG. 12 is a view similar to FIG. 7, but showing operation of the lock pins at the time when the vane rotor is turned to the fully locked intermediate angular position.

It is to be noted that in the condition of FIG. 12, head portion 27*a* of first lock pin 27 contacts a left vertical wall 24*b* of first lock recess 24 and head portion 28*a* of second lock pin 28 contacts a right vertical wall 25*c* of second lock recess 25, and thus turning of vane rotor 9 in both retarding and advancing directions is suppressed.

That is, when vane rotor 9 comes to the angular position as shown in FIG. 12, a fully locked condition of vane rotor 9 is established.

Figure 5:
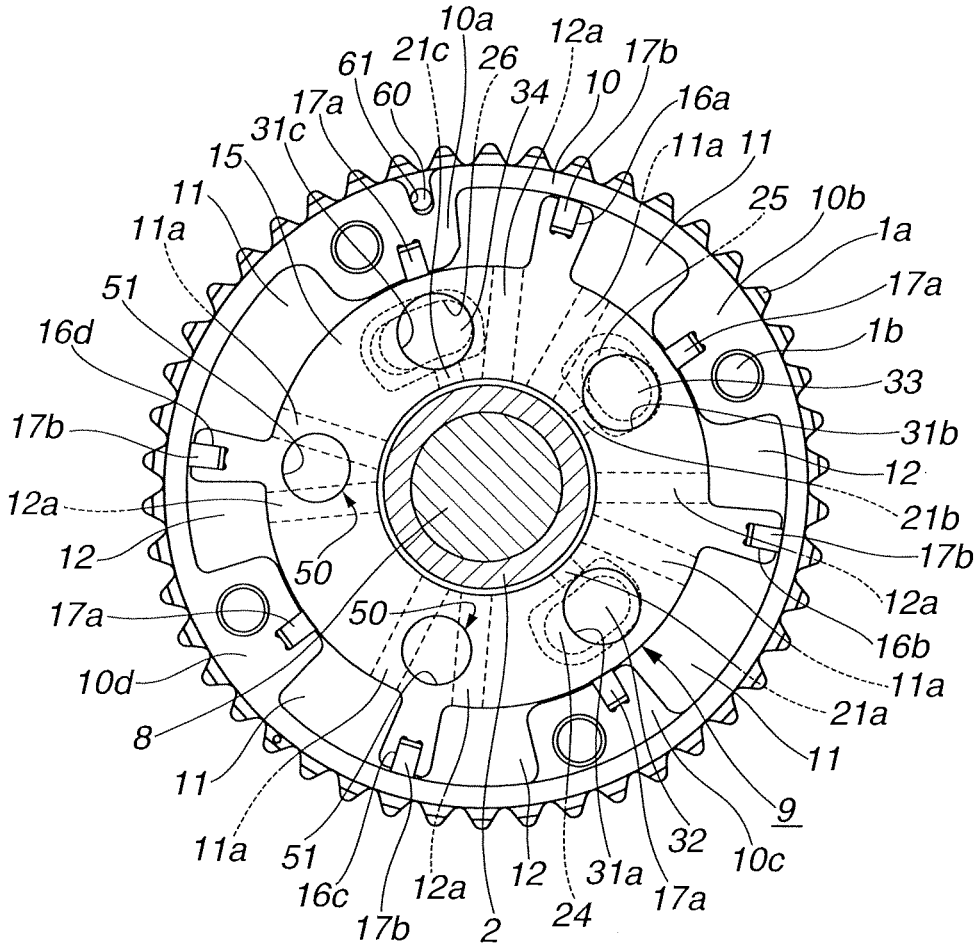
FIG. 5 is a view similar to FIG. 4, but showing a condition in which the vane rotor takes a fully locked intermediate angular position.

It is to be noted that in the invention, the full locked condition of vane rotor 9 is established when vane rotor 9 comes to a predetermined intermediate angular position as shown in FIG. 5.

As will be understood from the above description, as vane rotor 9 is turned in an advancing direction from the most retarded angular position toward the predetermined intermediate angular position (viz., the position as shown in FIG. 5), third lock pin 29, second lock pin 28 and first lock pin 27 make so-called semi-engaged conditions of vane rotor 9 one after another and finally second and first lock pins 28 and 27 make up the fully locked condition of vane rotor 9.

In other words, during the above-mentioned turning of vane rotor 9, five step ratchet-like movement is applied to vane rotor 9 by the three lock pins 29, 28 and 27 and their corresponding lock recesses 26, 25 and 24.

As is seen from FIG. 2, an air breather 39 is provided for communicating first pin hole 31*a* with the open air to smooth movement of first lock pin 27. Similar air breathers are also provided for communing second and third pin holes 31*b* and 31*c* with the open air for smooth movement of second and third lock pins 28 and 29.

As is seen from FIG. 2, hydraulic circuit 5 comprises a retarding hydraulic passage 18 that feeds retarding operation chambers 11 with a hydraulic pressure through respective retarding hydraulic holes 11*a* formed in vane rotor 9, an advancing hydraulic passage 19 that feeds advancing operation chambers 12 with a hydraulic pressure through respective advancing hydraulic holes 12*a* formed in vane rotor 9, a locking/unlocking hydraulic passage 20 that feeds and drains a hydraulic pressure to and from the above-mentioned first, second and third lock-cancelling operation chambers 32, 33 and 34 through a fluid passage 20*a* formed in intake camshaft 2, an oil pump 40 that selectively feeds a hydraulic fluid to retarding and advancing hydraulic passages 18 and 19 and feeds the hydraulic fluid to locking/unlocking hydraulic passage 20, and an electromagnetic switch valve 41 that, in accordance with an operation condition of the engine, switches ON/OFF state of the retarding and advancing hydraulic passages 18 and 19 and the feeding/draining state of locking/unlocking hydraulic passage 20.

Retarding and advancing hydraulic passages 18 and 19 have respective ends that are connected to ports (not shown) provided by electromagnetic switch valve 41 and respective other ends that are connected, through respective annular grooves 18*b* and 19*b* provided by intake camshaft 2, to parallelly extending retarding and advancing hydraulic passages 18*a* and 19*a* formed in the end portion 2*a* of intake camshaft 2.

The end portion 2*a* of intake camshaft 2 is provided at its cylindrical outer surface with first and second grooves 18*c* and 19*c* that are connected to the retarding and advancing hydraulic holes 11*a* and 12*a* respectively.

As will be understood from FIGS. 1 to 4, the one end of locking/unlocking hydraulic passage 20 is connected to a lock port provided by electromagnetic switch valve 41, and the other end of the passage 20 is connected to the first, second and third lock-cancelling operation chambers 32, 33 and 34 through a groove 20*b* provided at the outer cylindrical surface of intake camshaft 2, axially extending fluid passage 20*a* formed in intake camshaft 2 and radially extending branched passages 21*a*, 21*b* and 21*c* (see FIG. 4) formed in intake camshaft 2.

As is seen from FIG. 2, around the end portion 2*a* of intake camshaft 2, there is formed a third groove 20*c* through which the fluid passage 20*a* is connected to the branched passages 21*a*, 21*b* and 21*c*.

Oil pump 40 may be of a trochoid type driven or powered by a crankshaft of the engine. In the trochoid type, upon rotation of inner and outer rotors, the hydraulic fluid in an oil pan 42 is sucked into the pump and discharged to the outside through a discharge passage 40*a*. In operation of an associated internal combustion engine, part of the discharged hydraulic fluid is fed to various frictional elements of the engine through a main oil gallery M/G and remaining part of the discharged fluid is applied to electromagnetic switch valve 41.

Discharge passage 40*a* is provided at its downstream portion with both an oil filter (not shown) that filters the discharged hydraulic fluid and a flow control valve (not shown) that returns an excessive part of the discharged fluid from discharge passage 40 back to oil pan 42 through a drain passage 43.

As is seen from FIG. 2, electromagnetic switch valve 41 is of a proportional type having six ports and six positions.

The valve 41 comprises generally a cylindrical valve body, a spool member axially slidably received in the valve body, a valve spring installed in one end of valve body to bias the spool member in one direction (viz., rightward in the drawing) and an electromagnetic solenoid connected to the other end of the valve body to move the spool member in the other direction against the valve spring.

Designated by numeral 35 is an electronic controller that is connected to the electromagnetic solenoid. Upon receiving a controlled current from the controller 35, the solenoid moves the spool member to one of the six positions against or in cooperation with the force of the valve spring. Upon this, one of retarding and advancing hydraulic passages 18 and 19 is connected to discharge passage 40*a* from oil pump 40 and at the same time the other of the hydraulic passages 18 and 19 is connected to drain passage 43. Like this, locking/unlocking hydraulic passage 20 is selectively connected to discharge passage 40*a* and drain passage 43.

By moving the spool member to either one of the six positions, switching of ports is selectively carried out to vary the angular position of vane rotor 9 relative to sprocket 1 and at the same time, switching of locking/lock cancelling operation of first, second and third lock pins 27, 28 and 29 relative to first, second and third lock recesses 24, 25 and 26 is selectively carried out to selectively permit and suppress free rotation of vane rotor 9.

Electronic controller 35 comprises a micro-computer that processes various information signals issued from a crank angle sensor, an air flow meter, an engine cooling water temperature sensor, an engine temperature sensor, a throttle valve position sensor and a cam angle sensor (viz., means for sensing a phase of intake camshaft 2) to produce various instruction signals one of which is applied to the electromagnetic solenoid of electromagnetic switch valve 41. That is, upon receiving the instruction signal (viz., controlled pulsed current), the switch valve 41 moves the spool member to a desired position.

As will be seen from FIGS. 2 to 6, between each pair of the retarding and advancing hydraulic holes 11*a* and 12*a* that puts therebetween the vane 16*a*, 16*b*, 16*c* or 16*d*, there are provided two passage control mechanisms 50 and 50 that function to establish and block a fluid communication between retarding hydraulic holes 11*a* and advancing hydraulic holes 12*a*.

Since these two mechanisms 50 and 50 are substantially the same in construction, only one of them will be described in the following with the aid of the drawings.

That is, as is seen from FIGS. 2 and 4, each passage control mechanism 50 is provided on rotor 15 at a generally opposite side of first, second and third pin holes 31*a*, 31*b* and 31*c* and comprises a communication hole 51 that extends axially in rotor 15 and connects retarding and advancing hydraulic holes 11*a* and 12*a*, a spool member 52 that is slidably received in communication hole 51 to control the fluid communication condition between the holes 11*a* and 12*a*, a coil spring 53 that biases the spool member 52 in a direction to establish the fluid communication between the holes 11*a* and 12*a*, and a fluid passage opening 54 that is formed in rotor 15 and functions to move the spool member 52 against coil spring 53 in a direction to block the fluid communication between the holes 11*a* and 12*a* when receiving a certain amount of hydraulic pressure.

As will be understood from FIGS. 1 and 4, the communication hole 51 has substantially the same diameter as first, second and third pin holes 31*a*, 31*b* and 31*c*. As is seen from FIG. 4, the communication hole 51 in rotor 15 is arranged to straddle the neighboring holes 11*a* and 12*b*.

As is seen from FIG. 1, spool member 52 comprises a smaller diameter center stem portion 52*a*, a larger diameter valve portion 52*b* formed on one end of the stem portion 52*a* and a larger diameter slider portion 52*c* formed on the other end of the stem portion 52*a*. The valve portion 52 and the slider portion 52*c* have the same diameter.

As will be understood from FIG. 2, due to the nature of the shape, spool member 52 has around the stem portion 52*a* an annular groove 52*d*. That is, when spool member 52 is moved to the rightmost position in FIG. 2 by the force of coil spring 53, the retarding and advancing hydraulic holes 11*a* and 12*a* become communicated to each other through annular groove 52*d*. It is to be noted that valve portion 52*b* has such an axial length as to sufficiently close advancing hydraulic hole 12*a*.

As is seen from FIG. 2, coil spring 53 has a right end seated on a bottom of a bore formed in slider portion 52*c* and a left end seated on front plate 13. Thus, due to the work of coil spring 53, spool member 52 is biased rightward in the drawing.

The fluid passage opening 54 is arranged to face a pressure receiving surface 52*e* possessed by valve portion 52*b*. When the opening 54 becomes communicated with third groove 20*c* of fluid passage 20*a* of locking/unlocking hydraulic passage 20, a hydraulic pressure in locking/unlocking hydraulic passage 20 is applied to the pressure receiving surface 52*e* thereby to move spool member 52 leftward in FIG. 2.

In the following, operation of the valve timing control device of the first embodiment will be described with the aid of the drawings, particularly FIGS. 2 and 3.

When, after normal cruising of an associated motor vehicle, an ignition switch is turned off to stop the engine, electric energization of electromagnetic switch valve 41 is shut off and thus the spool member is moved to the rightmost position (I-position) in FIG. 2 by the force of the valve spring. With this, discharge passage 40*a* of oil pump 40 becomes connected to both retarding hydraulic passage 18 and advancing hydraulic passage 19 and at the same time, locking/unlocking hydraulic passage 20 is connected to drain passage 43, as shown in FIG. 2.

At the same time, oil pump 40 is stopped and thus a pressure supply to retarding or advancing operation chambers 11 or 12, first, second or third lock-cancelling operation chamber 32, 33 or 34 and pressure receiving surface 52*e* of spool member 52 is all stopped.

Now, the following description will be directed an idling condition of the engine that takes place after the associated motor vehicle stops after normal cruising.

Under this idling condition, each retarding operation chamber 11 is supplied with the hydraulic fluid causing vane rotor 9 to take the most retarded angular position as shown in FIG. 4. In this condition, as is seen from FIG. 7, first, second and third lock pins 27, 28 and 29 are kept disengaged from their corresponding lock recesses 24, 25 and 26. That is, leading ends of these three lock pins 27, 28 and 29 are pressed against inside surface 1*c* of sprocket 1.

As is known, just after off-turning of an ignition switch, intake camshaft 2 of the engine is applied with a positive/negative alternating torque induced by the force of the valve springs of the engine.

When, due to the work of the alternating torque particularly negative torque, vane rotor 9 is forced to turn, while repeating a reciprocating swing movement, to the intermediate angular position of FIG. 5, third, second and first lock pins 29, 28 and 27 are brought into engagement with their corresponding third, second and first lock recesses 26, 25 and 24 one after another in the above-mentioned manner.

When vane rotor 9 is finally turned to the intermediate angular position, the three lock pins 29, 28 and 27 are deeply engaged with their corresponding lock recesses 26, 25 and 24 as is seen from FIG. 12. That is, so-called fully locked condition of vane rotor 9 is established at the intermediate angular position, and thus, the intermediate angular position of vane rotor 9 can be kept.

The manner of the latchet-like turning of vane rotor 9 will be easily understood from the following description with the aid of FIGS. 7 to 12.

When, due to OFF turning of the ignition switch of the associated motor vehicle, vane rotor 9 taking the position of FIG. 7 is forced to turn slightly in an advancing direction (viz., the direction indicted by the arrow "Ad") due to negative component of the alternating torque applied to intake camshaft 2. At the same time, output of the pulsed current to electromagnetic switch valve 41 is stopped and thus feeding of hydraulic pressure to first, second and third lock-cancelling operation chambers 32, 33 and 34 is stopped.

Accordingly, as is seen from FIGS. 7 and 8, by the negative torque (viz., negative component of alternating torque) applied to vane rotor 9, first, second and third lock pins 27, 28 and 29 are moved rightward in FIG. 7 (viz., in the advancing direction) on inside surface 1*c* of sprocket 1 and then as is seen in FIG. 8, third lock pin 29 is brought into engagement with first bottom 26*a* of third lock recess 26 keeping the contact between inside surface 1*c* of sprocket 1 with each of first and second lock pins 27 and 28. That is, in such case, first and second lock pins 27 and 28 are biased against inside surface 1*c* of sprocket 1 due to work of first and second springs 36 and 37.

When, under this condition, vane rotor 9 is applied with a positive torque (viz., positive component of the alternating torque) and thus biased in a retarding direction (viz., the direction indicated by the arrow "Re" in FIG. 8), turning of vane rotor 9 in such retarding direction is suppressed due to abutting of head portion 29*a* of third lock pin 29 against the vertical wall raised from first bottom 26*a*.

Thereafter, due to application of a subsequent negative torque (viz., negative component of the alternating torque), vane rotor 9 is turned further in the advancing direction as is seen in FIG. 9 and thus third lock pin 29 is brought into engagement with second bottom 26*b* of third lock recess 26. Until this time, first and second lock pins 27 and 28 are kept disengaged from their corresponding lock recesses 24 and 25 as shown.

Figure 10:
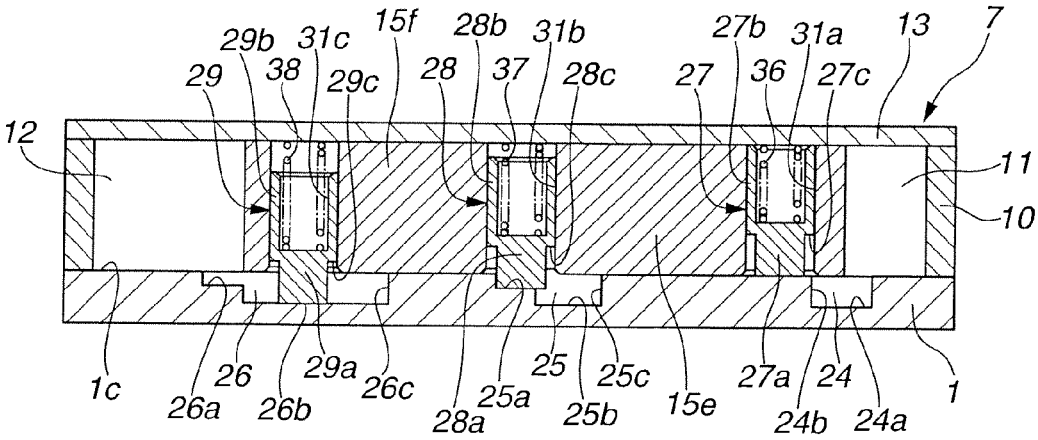
FIG. 10 is a view similar to FIG. 7, but showing operation of the lock pins at the time when the vane rotor is still further turned in the advancing direction.

When, as is seen from FIG. 10, due to further negative torque, vane rotor 9 is still turned in the advancing direction and brought to a position where third lock pin 29 contacts an intermediate position of second bottom 26*b* of third lock recess 26, second lock pin 28 is brought into engagement with first bottom 25*a* of second lock recess 25. Of course, in this condition, turning of vane rotor 9 in the retarding direction caused by subsequent positive torque is suppressed due to abutment of head portion 28*a* of second lock pin 28 against the vertical wall raised from the first bottom 25*a*.

When, thereafter due to application of subsequent negative torque, vane rotor 9 is turned in the advancing direction, second lock pin 28 is brought into engagement with second bottom 25*b* of second lock recess 25, as is seen from FIG. 11. In this condition, turning of vane rotor 9 in the retarding direction caused by subsequent positive torque is suppressed due to abutment of head portion 28*a* of second lock pin 28 against the vertical wall raised from the second bottom 25*b*.

When, thereafter due to application of subsequent negative torque, vane rotor 9 is turned in the advancing direction, first lock pin 27 is brought into engagement with first lock recess 24 as is seen from FIG. 12.

As has been mentioned hereinabove and as is seen from FIG. 12, under this condition, first lock pin 27 contacts a left inside wall 24*b* of first lock recess 24 and second lock pin 28 contacts a right inside wall 25*c* of second lock recess 25, and thus turning of vane rotor 9 in both retarding and advancing directions is suppressed. That is, so-called fully locked condition of vane rotor 9 becomes established when vane rotor 9 comes to the angular position of FIG. 12, that is, the predetermined intermediate angular position.

When thereafter (which may be after about several hours from the last engine stop) it is intended to start the engine, the ignition switch is turned ON.

Upon this, cranking is started and thus oil pump 40 is started to operate thereby feeding the discharged hydraulic fluid to both regarding and advancing operation chambers 11 and 12 through retarding and advancing hydraulic passages 18 and 19 respectively. Under this condition, locking/unlocking hydraulic passage 20 and drain passage 43 are kept communicated, and thus, vane rotor 9 assumes the locked condition of FIG. 12, that is, the fully locked intermediated angular position.

It is to be noted that under this engine start condition and under idling of the engine, electronic controller 35 operates in a manner to keep the full engaged intermediate angular position of vane rotor 9 with the aid of electromagnetic switch valve 41.

When, due to depression of an accelerator pedal, the engine is brought a condition just before a low speed low load operation condition or a high speed high load operation condition, electronic controller 35 controls electromagnetic switch valve 41 in the following manner.

That is, upon receiving a control signal from electronic controller 35, the spool member of the switch valve 41 is moved to a sixth position (viz., VI-position) against the biasing spring. With this movement, discharge passage 40*a* becomes communicated with locking/unlocking hydraulic passage 20 while keeping a communication of discharge passage 40*a* with each of the retarding and advancing hydraulic passages 18 and 19.

Accordingly, the hydraulic pressure is supplied to first, second and third lock-cancelling operation chambers 32, 33 and 34 through locking/unlocking hydraulic passage 20 and fluid passage 20*a*. Upon this, first, second and third lock pins 27, 28 and 29 become disengaged from their corresponding first, second and third lock recesses 24, 25 and 26 as will be imagined from FIG. 12. That is, the fully locked condition of vane rotor 9 at the intermediate angular position becomes cancelled. Thus, turning of vane rotor 9 in both retarding and advancing directions becomes permitted and at the same time, feeding of hydraulic pressure to both retarding and advancing operation chambers 11 and 12 is carried out.

If, under this condition, feeding of the hydraulic pressure is made to only one of the groups of retarding and advancing operation chambers 11 and 12, vane rotor 9 is biased to turn in one direction inducing such a possibility that first, second and third lock pins 27, 28 and 29 are not smoothly disengaged from their corresponding first, second and third lock recesses 24, 25 and 26. That is, in such case, a slight interlocking takes place between the rotor 15 and housing 7. That is, upon such turning of vane rotor 9, first, second and third lock pins 27, 28 and 29 are forced to receive a shearing force due to their sliding engagement with first, second and third pin holes 31*a*, 31*b* and 31*c* of vane rotor 9 (viz., rotor 15) as well as first, second and third lock recesses 24, 25 and 26 of sprocket 1.

Furthermore, if, under the above-mentioned condition, no hydraulic pressure is applied to both the retarding and advancing operation chambers 11 and 12, it tends to occur that due to the alternating torque, vane rotor 9 is subjected to a reciprocative swing movement freely causing production of collision noises of vane 16*a* against shoe 10*a* of cylindrical body 10 (see FIG. 4).

It is however to be noted that in the first embodiment of the invention, under such condition, both the operation chambers 11 and 12 are supplied with the hydraulic pressure, the above-mentioned undesired phenomena can be avoided.

When, thereafter, the engine is brought to for example the low speed low load operation condition, the spool member of electromagnetic switch valve 41 is moved to a third position (III-position) against the force of valve spring. With this, advancing hydraulic passage 19 becomes communicated with drain passage 43, and locking/unlocking hydraulic passage 20 and retarding hydraulic passage 18 become communicated with discharge passage 40*a*.

With this operation, the disengaged condition of the lock pins 27, 28 and 29 from their lock recesses 24, 25 and 26 is kept, the hydraulic pressure in advancing operation chambers 12 is decreased and the hydraulic pressure in retarding operation chambers 11 is increased. Thus, vane rotor 9 is turned toward the most retarded angular position relative to housing 7.

With such turning of vane rotor 9, valve overlap of intake valves of the internal combustion engine is reduced inducing reduction of residual gas in each cylinder. Thus, combustion efficiency of the engine is increased, and thus, stable operation of the engine and improvement in mileage are obtained.

When thereafter the engine is brought to for example the high speed high load operation condition, the spool member of electromagnetic switch valve 41 is moved to a fifth position (viz., V-position). With this, retarding hydraulic passage 18 becomes communicated with drain passage 43 and discharge passage 40*a* becomes communicated with both advancing hydraulic passage 19 and locking/unlocking hydraulic passage 20.

Accordingly, the disengagement of first, second and third lock pins 27, 28 and 29 from the corresponding lock recesses 24, 25 and 26 is kept, the hydraulic pressure in retarding operation chambers 11 is reduced and the hydraulic pressure in advancing operation chambers 12 is increased. With this, vane rotor 9 is turned to the most advanced angular position relative to housing 10 as is shown in FIG. 6. Upon this, intake camshaft 2 takes the most advanced angular position relative to sprocket 1.

With such turning of vane rotor 9, valve overlap between intake and exhaust valves is increased inducing increase of intake air charging efficiency. Thus, improvement in output torque of the engine is achieved.

In case wherein hydraulic pressure is kept applied to locking/unlocking hydraulic passage 20 from discharge passage 40*a*, the pressure receiving surface 52*e* of spool member 52 of each passage control mechanism 50 is applied with a certain hydraulic pressure. Thus, as is seen from FIG. 3, each spool member 52 of the mechanism 50 is moved leftward in the drawing against the force of coil spring 53. Thus, the center stem portion 52*a* closes the advancing hydraulic hole 12*a* shutting off the communication with the retarding hydraulic hole 11*a*. Accordingly, under such condition, hydraulic fluid flow between retarding operation chambers 11 and advancing operation chambers 12 is not carried out. Thus, due to the hydraulic pressure applied to one group of the retarding and advancing operation chambers 11 and 12, vane rotor 9 can be quickly turned in the retarding or advancing direction.

When the engine is brought to idling operation condition from the above-mentioned low speed low load operation condition or high speed high load operation condition, energization of electromagnetic switch valve 41 is stopped by electronic controller 35. Upon this, the spool member of the switch valve 41 is moved to the first position due to the force of the valve spring. Upon this, locking/unlocking hydraulic passage 20 becomes communicated with drain passage 43 and at the same time, discharge passage 40*a* becomes communicated with both the retarding and advancing hydraulic passages 18 and 19. With this action, retarding and advancing operation chambers 11 and 12 are supplied with substantially same hydraulic pressure.

Accordingly, even when vane rotor 9 is in a retarded angular position having no lock pins 27, 28 and 29 engaged with their corresponding lock recesses 24, 25 and 26 as shown in FIG. 7, vane rotor 9 is forced to turn in an advancing direction due to the work of the alternating torque applied to intake camshaft 2 when the ignition switch is turned off. That is, due to turning of vane rotor 9 in the advancing direction, third, second and first lock pins 29, 28 and 27 held by vane rotor 9 are brought into engagement with their corresponding lock recesses 26, 25 and 24 one after another as is mentioned hereinabove. Finally, vane rotor 9 becomes locked in its intermediate angular position as is seen from FIG. 12.

When the engine continues a predetermined operation condition, electromagnetic switch valve 41 is controlled to move its spool member to a fourth position (IV-position). Upon this, the communication of retarding hydraulic passage 18 and advancing hydraulic passage 19 to discharge passage 40*a* and drain passage 43 becomes shut off and at the same time discharge passage 40*a* becomes communicated with locking/unlocking hydraulic passage 20. With this, retarding and advancing operation chambers 11 and 12 stably hold therein hydraulic pressure and all lock pins 27, 28 and 29 are disengaged from their corresponding lock recesses 24, 25 and 26 providing vane rotor 9 with a lock cancelled condition.

Accordingly, vane rotor 9 is permitted to turn to a desired angular position relative to housing 7. With this, intake valves of the engine are operated at a valve timing determined by the desired angular position of vane rotor 9.

As is mentioned hereinabove, in accordance with the operation condition of the engine, electronic controller 35 controls electromagnetic switch valve 41 to move the spool member to a selected one of the six positions. With this position selection, phase varying mechanism 3 and lock mechanism 4 are controlled to cause intake camshaft 2 to take a desired angular position relative to sprocket 1, which improves the control accuracy of valve timing.

If, with vane rotor 9 taking for example the most retarded angular position as shown in FIG. 4, the engine is subjected to an engine stall, subsequent ON turning of the ignition switch to start cranking of the engine would bring about the following phenomena.

That is, before the subsequent ON turning of the ignition switch, both retarding and advancing operation chambers 11 and 12 are kept filled with hydraulic fluid. Thus, if, under this condition, the ignition switch is turned ON for cranking the engine, the degree of reciprocative swing movement of vane rotor 9 caused by the positive/negative alternating torque is small. Accordingly, the ratchet-like movement of vane rotor 9 to the intermediate angular position is not smoothly produced by third, second and first lock pins 29, 28 and 27 and their corresponding lock recesses 26, 25 and 14, which causes turning of vane rotor 9 to the fully locked intermediate angular position (viz., the position of FIG. 5) to take a longer time.

However, in the embodiment of the invention, as is mentioned hereinabove, when electromagnetic switch valve 41 is deenergized, the hydraulic fluid supply from locking/unlocking hydraulic passage 20 to the two passage control mechanisms 50 and 50 is stopped. Thus, as is seen from FIG. 2, due to the force of coil springs 53, spool members 52 of the mechanisms are moved rightward in the drawing. With this movement, retarding hydraulic holes 11*a* and advancing hydraulic holes 12*a* become communicated through annular grooves 52*d* and communication holes 51. Under this condition, a fluid flow between retarding and advancing operation chambers 11 and 12 is permitted through retarding and advancing hydraulic holes 11*a* and 12*a* and annular grooves 52*d*.

Accordingly, when, upon generation of negative alternating torque caused by an initial stage of the engine cranking, a force is applied to vane rotor 9 to instantly turn in the advancing direction, the hydraulic fluid in retarding operation chambers 11 is forced to move to advancing operation chambers 12 through annular grooves 52*d* by the turning of vane rotor 9.

That is, by the first negative alternating torque, vane rotor 9 can be smoothly and quickly turned in the advancing direction. In other words, the degree of reciprocative switch movement of vane rotor 9 can be increased.

Thus, in this first embodiment of the invention, the above-mentioned ratchet-like turning of vane rotor 9 in the advancing direction is smoothly carried out. Accordingly, at the time of engine cranking, turning of vane rotor 9 to the fully locked intermediate angular position is quickly achieved, which improves the startability of the engine.

In the above-mentioned engine stall, electromagnetic switch valve 41 is deenergized. In addition to the engine stall, the de-energization of the valve 41 may be induced by electronic controller 35 when the valve 41 is subjected to a breaking of wire and/or when the spool member of the valve 41 fails to carry out a smoothed movement due to dusts or the like adhered thereto. Accordingly, when, with retarding and advancing operation chambers 11 and 12 being kept communicated to each other, the above-mentioned troubles take place, vane rotor 9 taking the most retarded angular position can be smoothly and quickly turned to the fully locked intermediate angular position (viz., the position of FIG. 4) upon re-starting of the engine. That is, also in this case, the hydraulic fluid in retarding operation chambers 11 is led into advancing operation chambers 12 through passage control mechanisms 50, which smoothes turning of vane rotor 9 in the advancing direction.

As is mentioned hereinabove, in the first embodiment, at the time of restarting the engine after stall of the same, the hydraulic fluid in retarding operation chambers 11 is quickly led into advancing operation chambers 12 through the passage control mechanisms 50 and thus vane rotor 9 in the most retarded angular position is quickly turned to the fully locked intermediate angular position which is suitable for effecting starting of the engine. That is, excellent re-startability of the engine is obtained.

Since first, second and third lock pins 27, 28 and 29 are installed in vane rotor 9 through first, second and third pin holes 31*a*, 31*b* and 31*c*, the thickness of each vane 16*a*, 16*b*, 16*c* or 16*d* in a circumferential direction can be sufficiently reduced. Thus, it is possible to provide vane rotor 9 with a sufficiently large angular position relative to housing 7.

Furthermore, in the first embodiment of the invention, the two functions, that are the function of controlling the hydraulic pressure applied to retarding and advancing operation chambers 11 and 12 and the other function of controlling the hydraulic pressure applied to first, second and third lock-cancelling operation chambers 32, 33 and 34, are effected by only one electromagnetic switch valve 41. Accordingly, mounting the valve timing control device of the embodiment on or in the engine proper is easily made, which induces reduction in production cost of the engine.

In case of stopping the engine by turning the ignition switch off, turning of vane rotor 9 to the fully locked intermediate angular position is assuredly effected by lock mechanism 4. Furthermore, due to the unique shape and arrangement of second and third lock recesses 25 and 26 (see FIGS. 7 to 12), turning of vane rotor 9 in the advancing direction causes second and third lock pins 28 and 29 to provide vane rotor 9 with a ratchet-like movement, which brings about a satisfied reliability of guided turning of vane rotor 9.

Due to the five step ratchet-like turning of vane rotor 9 caused by the five bottoms 26*a*, 26, 25*a*, 25*b* and 24*a* of the three lock recesses 26, 25 and 24, turning of vane rotor 9 toward the fully locked intermediate angular position is assuredly made even if the vane rotor 9 is in the most retarded angular position.

The hydraulic pressure applied to first, second and third lock-cancelling operation chambers 32, 33 and 34 is independent from the hydraulic pressure applied to retarding and advancing operation chambers 11 and 12. Accordingly, feeding responsiveness of the hydraulic pressure to the chamber 32, 33 and 34 is improved, which smoothes back movement of first, second and third lock pins 27, 28 and 29. Furthermore, there is no need of providing a sealing mechanism between each of retarding and advancing operation chambers 11 and 12 and each of first, second and third lock-cancelling operation chambers 32, 33 and 34.

Due to provision of communication hole 51 that extends axially in rotor 15 to connect retarding and advancing hydraulic holes 11*a* and 12*a*, the structure for the fluid communication can be made simple, which simplifies the processing operation.

Furthermore, in the embodiment, lock mechanism 4 comprises three groups of lock sections that are a first group including first lock pin 27 engageable with bottom 24*a* of first lock recess 24, a second group including second lock pin 28 engageable with first and second bottoms 25*a* and 25*b* of second lock recess 25 and a third group including third lock pin 29 engageable with first and second bottoms 26*a* and 26*b* of third lock recess 26, and thus, thickness of sprocket 1 that has first, second and third lock recesses 24, 25 and 26 can be sufficiently reduced. Reduction in thickness of sprocket 1 brings about reduction of an axial length of the valve timing control device, which increases freedom in layout of the device. That is, if the above-mentioned five step ratchet-like turning of vane rotor 9 is intended to be made by only one lock pin, it is necessary to provide vane rotor 9 with an increased thickness.

In the above-mentioned embodiment, ON/OFF condition of advancing hydraulic holes 12*a* is produced by movement of spool members 52 of the passage control mechanisms 50. If desired, a gradual change in a sectional area of each advancing hydraulic hole 12*a*, which is effected in accordance with the movement of spool member 52, may be used for controlling electromagnetic switch valve 41.

Second Embodiment

Figure 13A:
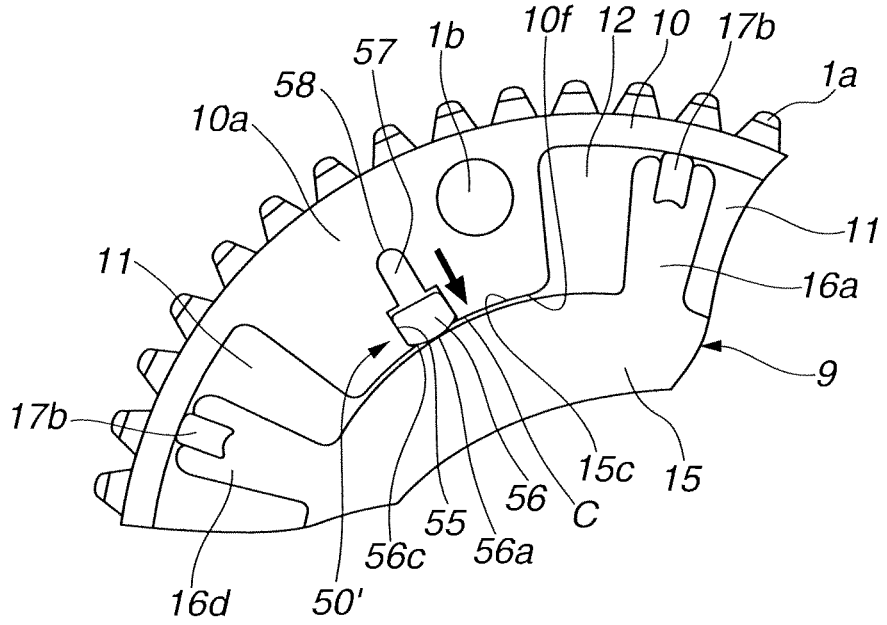
Figure 13B:
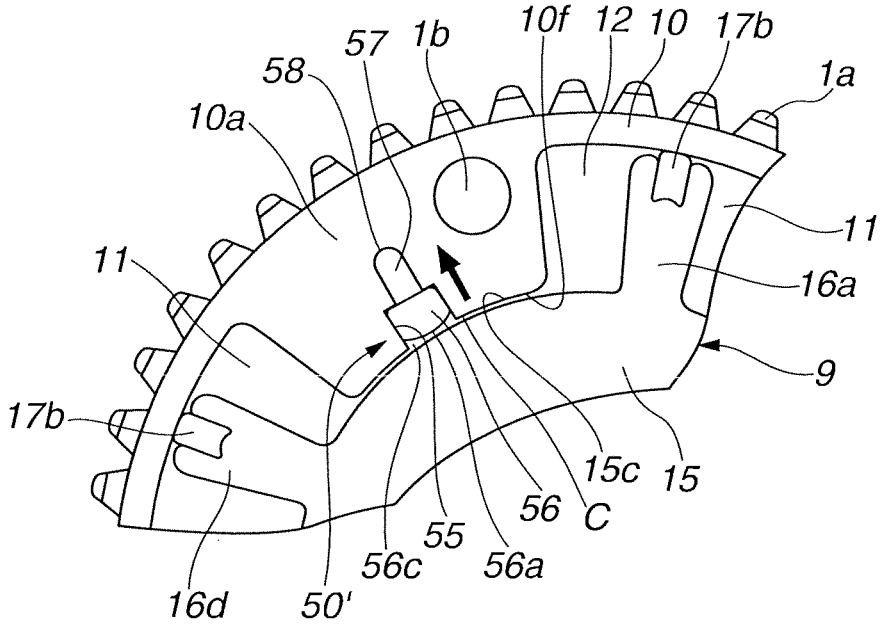

Referring to FIGS. 13A and 13B, there is shown a valve timing control device of a second embodiment of the present invention.

In this second embodiment, in place of passage control mechanism 50 used in the first embodiment, there is employed a passage control mechanism 50'.

Due to work of this passage control mechanism 50', there can be produced a communication space "C" between a concave inside surface 10*f* of first shoe 10*a* of cylindrical body 10 and a convex outside surface 15*c* of rotor 15, as will be seen from FIG. 13B. Upon this, the neighboring retarding and advancing operation chambers 11 and 12 become communicated to each other through the space "C" produced.

As is seen from FIG. 13A, passage control mechanism 50' comprises a rectangular groove 55 that is formed in first shoe 10*a* in a manner to face the convex outside surface 15*c* of rotor 15, a piston-like seal member 56 that is slidably received in rectangular groove 55 in a manner to selectively close and open the space "C", a hydraulic pressure chamber 57 that is provided behind rectangular groove 55 and a hydraulic pressure passage 58 that extends from the above-mentioned locking/unlocking hydraulic passage 20 to pressure chamber 57.

As will be understood when referring to FIG. 1, rectangular groove 55 has longitudinal ends that are hermetically closed the inside surface 1*c* of sprocket 1 and an inside surface of front plate 13 respectively. Piston-like seal member 56 radially movably received in rectangular groove 55 is an elongate member with a semicylindrical cross section. Preferably, the seal member 56 is constructed of an elastic material, such as rubber, resin or the like. As shown, the seal member 56 has a convex top surface 56*a* that is contactable with convex outside surface 15*c* of rotor 15.

Under normal operation of the engine, hydraulic pressure is led into pressure chamber 57 from discharge passage 40*a* (see FIG. 2) through locking/unlocking hydraulic passage 20 and thus the convex top surface 56*a* of the seal member 56 is pressed against convex outside surface 15*c* of rotor 15. Under this condition, as is seen from FIG. 13A, the communication space "C" is closed thereby shutting out the fluid communication between the neighboring retarding and advancing operation chambers 11 and 12.

While, if, due to stall of the engine, vane rotor 9 is stopped at the most retarded angular position and thereafter, the ignition switch is turned ON to start cranking of the engine, the following operation takes place.

That is, at an initial stage of the engine starting, the neighboring retarding and advancing operation chambers 11 and 12 are kept filled with hydraulic pressure. However, hydraulic pressure chamber 57 is not fed with hydraulic pressure yet. Accordingly, as is seen from FIG. 13B, due to work of a centrifugal force produced when housing 7 is rotated, piston-like seal member 56 is moved radially outward thereby opening the communication space "C".

Upon this, fluid communication between the neighboring retarding and advancing operation chambers 11 and 12 is permitted. With this, the degree of reciprocative swing movement of vane rotor 9 caused by the positive/negative alternating torque can be increased. As a result, the above-mentioned ratchet-like turning of vane rotor 9 in the advancing direction is effectively and quickly carried out. That is, turning of vane rotor 9 to the fully locked intermediate angular position is quickly made, which brings about improvement in startability of the engine.

It is to be noted that the present invention is not limited to the above-mentioned two embodiments. That is, if desired, the shape of spool member 52 of the passage control mechanism 50 can be changed.

In the above-mentioned second embodiment, only one passage control mechanism 50' is used. However, if desired, such mechanism 50' may be equally applied to other shoe 10*b*, 10*c* or 10*d* of housing 10.

The entire contents of Japanese Patent Application 2012-48697 filed Mar. 6, 2012 are incorporated herein by reference.

Although the invention has been described above with reference to the embodiments of the invention, the invention is not limited to such embodiments as described above. Various modifications and variations of such embodiments may be carried out by those skilled in the art, in light of the above description.

What is claimed is:

1. A valve timing control device of an internal combustion engine, comprising:

an annular housing rotated by a crankshaft of the engine and having a plurality of shoes on a peripheral inner surface thereof, adjacent two of the shoes defining therebetween an operation chamber;

a vane rotor connected to a camshaft of the engine to rotate therewith, the vane rotor being formed with vanes each dividing the operation chamber into an advancing operation chamber and a retarding operation chamber, the vane rotor being turned in an advancing or retarding direction relative to the annular housing when a hydraulic pressure is supplied to or discharged from the advancing and retarding operation chambers respectively;

a first lock member provided by one of the vane rotor and the annular housing and movable toward and away from the other of the vane rotor and the annular housing with a driving force different from the hydraulic pressure supplied to the operation chambers;

a second lock member provided by one of the vane rotor and the annular housing and movable toward and away from the other of the vane rotor and the annular housing with a driving force different from the hydraulic pressure supplied to the operation chambers;

a first lock recess provided by the other of the vane rotor and the annular housing and suppressing, when engaged with the first lock member, at least turning of the vane rotor in a retarding direction from a position between the most advanced and most retarded angular positions;

a second lock recess provided by the other of the vane rotor and the annular housing and suppressing, when engaged with the second lock member, at least turning of the vane rotor in an advancing direction from a position where the turning of the vane rotor in the retarding direction is suppressed due to engagement of the first lock member with the first lock recess;

a communication passage provided by one of the vane rotor and the annular housing to communicate the advancing and retarding operation chambers; and a passage control mechanism that establishes the communication between the advancing and retarding operation chambers through the communication passage when the engine is stopped and reduces a cross sectional area of the communication passage when, after starting of the engine, the engine comes to show a predetermined speed or higher.

2. A valve timing control device as claimed in claim 1, in which the passage control mechanism comprises a hydraulically operated valve body for varying the cross sectional area of the communication passage.

3. A valve timing control device as claimed in claim 2, in which the hydraulic pressure applied to the passage control mechanism is used for actuating the first and second lock members.

4. A valve timing control device as claimed in claim 2, in which the communication passage and the valve body are provided by the vane rotor.

5. A valve timing control device as claimed in claim 1, in which the passage control mechanism closes the communication passage when, after starting of the engine, the engine comes to show the predetermined speed or higher.

6. A valve timing control device as claimed in claim 1, in which by combining the plurality of shoes with the plurality of vanes, a plurality of paired advancing and retarding operation chambers are produced, and in which each pair of the advancing and retarding operation chambers is equipped with the communication passage and the passage control mechanism.

7. A valve timing control device as claimed in claim 1, in which the second lock recess has a stepped bottom of which depth increases as the bottom extends in an advancing direction.

8. A valve timing control device as claimed in claim 7, further comprising:

a third lock member provided by one of the vane rotor and the annular housing and movable toward and away from the other of the vane rotor and the annular housing with a driving force different from the hydraulic pressure supplied to the operation chambers; and a third lock recess provided by the other of the vane rotor and the annular housing and guiding, when engaged with the third lock member, the turning of the vane rotor in the advancing direction, the third lock recess having a stepped bottom of which depth increases as the bottom extends in the advancing direction.

9. A valve timing control device as claimed in claim 1, in which outer peripheral edges of the vanes and inner peripheral edges of the shoes are provided with sliding members that constitute part of the passage control mechanism.

10. A valve timing control device as claimed in claim 9, in which each of the sliding members is arranged to slidably abut against its partner member when a hydraulic pressure is applied thereto.

11. A valve timing control device as claimed in claim 10, in which each of the sliding members is arranged to form a clearance between it and its partner member when no hydraulic pressure is applied thereto.

12. A valve timing control device of an internal combustion engine, comprising:

an annular housing rotated by a crankshaft of the engine and having a plurality of shoes on a peripheral inner surface thereof, adjacent two of the shoes defining therebetween an operation chamber;

a vane rotor connected to a camshaft of the engine to rotate therewith, the vane rotor being formed with vanes each dividing the operation chamber into an advancing operation chamber and a retarding operation chamber, the vane rotor being turned in an advancing or retarding direction relative to the annular housing when a hydraulic pressure from an oil pump is supplied to or discharged from the advancing and retarding operation chambers respectively;

a lock mechanism provided between the vane rotor and the annular housing to suppress a turning of the vane rotor relative to the annular housing when a hydraulic pressure different from the hydraulic pressure supplied to the operation chambers is applied to the lock mechanism;

a communication passage provided by one of the vane rotor and the annular housing to communicate the advancing and retarding operation chambers; and a passage control mechanism that opens the communication passage when a discharge pressure of the oil pump is lower than a predetermined value and reduces a cross sectional area of the communication passage when the discharge pressure of the oil pump increases to the predetermined value.

13. A valve timing control device as claimed in claim 12, in which the passage control mechanism comprises a hydraulically operated valve body for varying the cross sectional area of the communication passage.

14. A valve timing control device as claimed in claim 13, in which the passage control mechanism has one end to which the discharge pressure from the oil pump is applied and the other to which a biasing force of a second biasing member is applied, and in which the valve body has a side surface by which the cross sectional area of the communication passage is reduced.

15. A valve timing control device as claimed in claim 14, in which the valve body is a spool member that has an annular groove at a portion other than both ends thereof, and in which the annular groove is used for increasing the cross sectional area of the communication passage.

16. A valve timing control device as claimed in claim 12, in which an advancing hydraulic passage communicated with the advancing operation chamber and a retarding hydraulic passage communicated with the retarding operation chamber are formed in the vane rotor, and in which the communication passage is arranged to extend between the advancing and retarding hydraulic passages to communicate the advancing and retarding hydraulic passages.

17. A valve timing control device as claimed in claim 16, in which the advancing and retarding hydraulic passages are arranged to extend radially outward from an inside portion of the vane rotor toward an outside portion of the same, and in which the valve body is arranged to expose to both the advancing and retarding hydraulic passages so that movement of the valve body brings about an open/close communication between the advancing and retarding hydraulic passages through the communication passage.

18. A valve timing control device as claimed in claim 17, in which the valve body is arranged to move in parallel with a rotation axis of the vane rotor.

19. A valve timing control device of an internal combustion engine, comprising:

a drive rotating member driven by a crankshaft of the engine;

a driven rotating member connected to a camshaft of the engine to rotate therewith, the driven rotating member dividing an interior of the drive rotation member into an advancing operation chamber and a retarding operation chamber, the driven rotating member being turned in an advancing or retarding direction relative to the drive rotating member when a hydraulic pressure is supplied to or discharged from the advancing and retarding operation chambers respectively;

a first lock member provided by one of the drive and driven rotating members and movable toward and away from the other of the drive and driven rotating members with a hydraulic pressure different from the hydraulic pressure supplied to the operation chambers;

a second lock member provided by one of the drive and driven rotating members and movable toward and away from the other of the driven and driven rotating members with a hydraulic pressure different from the hydraulic pressure supplied to the operation chambers;

a first lock recess provided by the other of the drive and driven rotating members and suppressing, when engaged with the first lock member, a turning of the driven rotating member in a retarding direction from a position between the most advanced and most retarded angular positions;

a second lock recess provided by the other of the drive and driven rotating members and suppressing, when engaged with the second lock member, a turning of the driven rotating member in an advancing direction from a position where the turning of the driven rotating member in the retarding direction is suppressed due to engagement of the first lock member and the first lock recess; and a communication passage provided by one of the drive and driven rotating members, the communication passage communicating the advancing operation chamber and the retarding operation chamber when the engine is stopped, and reducing a cross sectional area of the communication passage when, after starting of the engine, the engine comes to show a predetermined speed or higher.

* * * * *